United States Patent [19]

Eisenstein et al.

[11] Patent Number: 5,015,403

[45] Date of Patent: May 14, 1991

[54] PREPARATION OF LITHIUM-CALCIUM GREASE COMPOSITIONS

[75] Inventors: Stephen E. Eisenstein, Houston, Tex.; Wayne J. Kuchler, Kenner, La.

[73] Assignee: Shell Oil Company, Houston, Tex.

[21] Appl. No.: 498,116

[22] Filed: Mar. 23, 1990

[51] Int. Cl.[5] ..... C10M 117/02

[52] U.S. Cl. ..... 252/40; 252/17

[58] Field of Search ..... 252/17, 40

[56] References Cited

U.S. PATENT DOCUMENTS

| | | | |
|---|---|---|---|
| 2,641,577 | 6/1953 | O'Halloran | 252/40 |
| 2,704,363 | 3/1955 | Armstrong | 252/40 |
| 2,888,402 | 5/1959 | Nelson | 252/40 |
| 2,908,645 | 10/1959 | Morway | 252/40 |
| 2,929,780 | 3/1960 | O'Halloran | 252/40 |
| 2,929,781 | 3/1960 | Beerbower et al. | 252/40 |
| 2,959,548 | 11/1960 | O'Halloran et al. | 252/40 |
| 3,891,564 | 6/1975 | Carley et al. | 252/40 |

*Primary Examiner*—Jacqueline V. Howard

[57] ABSTRACT

A process for the preparation of a lubricating grease which comprises (a) dispersing in a major amount of a lubricating oil at about 180° F. to about 200° F. an effective amount of a saponifiable fatty material and lithium base to neutralize the fatty material, (b) then heating the resulting mixture from (a) to about 385° F. to about 410° F. at about ambient pressure to dissolve said fatty material, (c) homogenizing the resulting mixture from (b) at about 80 to about 200 psi while maintaining the temperature, (d) cooling the resulting mixture to a temperature below about 370° F., (e) adding calcium base to the resulting mixture to saponify the remaining (unsaponified) fatty material at about 290° F. to about 360° F. and about ambient pressure, and (f) homogenizing the resulting mixture at about 100 to about 150 psi while maintaining the temperature to obtain a lubricating grease composition. Preferably, the calcium bae in step (e) is substantially dry and is added at a temperature of from about 310° F. to about 360° F.

6 Claims, No Drawings

PREPARATION OF LITHIUM-CALCIUM GREASE COMPOSITIONS

BACKGROUND OF THE INVENTION

1. Field of the Invention

The present invention relates to. a process for the preparation of lithium-calcium grease compositions.

2. Description of the State of the Art

Lithium-calcium grease compositions have existed in the art for many years. These greases are traditionally prepared in sealed autoclaves where the ingredients are subjected to high temperatures and pressures during the cooking step. The resulting products are often inconsistent in quality due to over or under dehydration of the calcium soap portion of the grease and demonstrate poor mechanical stability and lack of batch to batch uniformity. It has been shown that in both open kettles and in sealed autoclaves, calcium soaps dehydrate readily and will not subsequently disperse into the required fibrous structure after being even mildly dehydrated. This dehydration, which causes the calcium soap to precipitate rather than disperse in the grease, reduces its ability to thicken the grease. The precipitated calcium soap cannot be re-dispersed even under vigorous milling (grinding/dispersing) conditions, nor can it be rehydrated by adding water, even at lower temperatures.

Additionally, the temperatures required for making lithium soap greases are over 100° F. higher than generally allowed for calcium grease. Thus, during the heating cycle with sealed autoclaves, the only water vented is that used to suspend and disperse the lithium and calcium hydroxides and then the autoclave is sealed to try to retain the remaining water for the water of crystallization of the calcium soap.

It is desirable to have a process which provides for proper lithium soap formation without completely dehydrating and precipitating the calcium soap, which process also produces greases of consistent quality and good mechanical properties.

SUMMARY OF THE INVENTION

The present invention is directed to a process for the preparation of a lubricating grease which comprises (a) dispersing in a major amount of a lubricating oil at about 180° to about 200° F. an effective amount of a saponifiable fatty material and lithium base to partially neutralize the fatty material, (b) then heating the resulting mixture from (a) to about 385° F. to about 410° F. at about ambient pressure to dissolve said fatty material, (c) homogenizing the resulting mixture from (b) at about 80 to about 200 psi maintaining the temperature, (d) cooling the resulting mixture from (c) to a temperature below about 370° F., (e) adding calcium base to the resulting mixture from (d) to saponify the remaining unsaponified fatty material at about 290° F. to about 360° F. and about ambient pressure, and (f) homogenizing the resulting mixture from (e) at about 100 to about 150 psi while maintaining the temperature to obtain a lithium-calcium mixed soap lubricating grease composition.

The process of the invention provides a method of preparing lithium-calcium based greases having specific properties of consistency and hardness at substantially ambient pressures in the high temperature heating steps without the necessary use of sealed autoclaves.

The saponifiable fatty materials used in the formulation of the soaps can be any of the naturally occurring or synthetic fats and fatty acids known in the art. Examples of these materials include saturated and unsaturated fatty acids having iodine numbers within the range of 0 to about 150 and having about 12 to about 30 carbon atoms, preferably about 14 to about 22 carbon atoms per molecule, such as lauric, myristic, palmitic, stearic, 12-hydroxystearic, 9, 10-dihydroxystearic, behenic, myristoleic, palmitoleic, oleic, linoleic, cottonseed oil fatty acids, palm oil fatty acids, hydrogenated fish oil fatty acid, lacceroic, ricoleic, erucic acids, hydrogenated castor oil or the like and mixtures thereof. The rapseed, palm, menhaden, herring, castor oils and the like. The use of 12-hydroxystearic acid or hydrogenated castor oil is preferred.

The homogenization step (c) or (f) can be conducted using procedures known in the art for the homogenization of oils and soaps. For example, the homogenization can be conducted using high rates of shear at about 50,000 to about 500,000 reciprocal seconds in homogenizing or milling devices, including a Morehouse mill, Charlotte mill, ink mill, Gaulin homogenizer or the like or by passing the mixture from (b) and/or (e) through a filter screen and/or partially opened valve. In step (c) the homogenizing is preferably at about 75 to about 250 psi, and in step (f) the homogenizing is preferably at about 75 to about 2000 psi.

Step (a) can be conducted at temperatures above ambient temperature but it is preferred to use ambient temperatures for economics and efficiency.

In step (d) the cooling of the resulting mixture can be by any cooling method conventionally known in the art of making soap greases. Examples are air cooling, water jacket or coil cooling or adding ambient temperature oil. The cooling temperature is to below about 370° F. and preferably between about 280° F. to about 360° F. If cooled below 280° F. then re-heating may be necessary to form the calcium soap component of the thickener.

In a preferred embodiment of step (e) of the invention the calcium base (hydroxide) is added in substantially dry form to provide for more effective use of the higher temperatures of addition and to provide greases of better properties. The classical method of adding the calcium base (hydroxide) as an aqueous slurry is also acceptable, but in such cases the mixture has to be cooled to under 200° F. to prevent excessive foaming due to steam evolution. A major advantage of the preferred embodiment of the instant invention is the use of dry calcium base (hydroxide) at higher temperature thus eliminating the need to cool the mixture to under 200° F. and then reheat the reaction mixture, thereby saving time and energy over the classical approaches to making grease, especially mixed lithium/calcium soap greases in open kettles. The temperature of the mixture in the calcium base (hydroxide) addition step can be from about 290° F. to about 360° F. and preferably, when using substantially dry calcium base (hydroxide), from about 310° F. to about 350° F., more preferably from about 315° F. to about 340° F. and especially from about 325° F. to about 335° F.

In preparing the greases, the lithium and calcium bases can be any compound of these metals which will form soaps under the process conditions as an aqueous slurry or dry material. For example, the lithium base can be lithium hydroxide monohydrate, lithium hydroxide, lithium carbonate, lithium oxide, and the like. The calcium bases can be hydrated lime, calcium hydroxide, calcium oxide, and the like. Lithium hydroxide monohydrate and calcium hydroxide are preferred. The lithium base is preferably added as an aqueous slurry and the calcium base as a dry material. The lithium and calcium bases and fatty material are added in steps (a) and (e), respectively, to the mixture of fatty material and lubricating oil and intimately admixed therewith to obtain a slurry.

The ratio of lithium and calcium soaps present in the grease products produced by the process of the invention can vary depending on the fatty material used and the base oil used and the desired properties of the resulting product as is well known in the art. For example, the mol ratio of lithium soap to calcium soap can vary from about 1:1 to about 8:1, preferably from about 3:1 to about 5:1.

The amount of soap of the fatty material present in the grease is usually from about 2% to about 25% by weight of the grease composition, preferably from about 4% to about 15% and especially from about 8.5% to about 10%. By selection of the amount of soap of the fatty material, the hardness of the grease can be adjusted as is known in the art.

The oil used to prepare the grease composition can be any of the conventional mineral or synthetic lubricating base stocks or mixtures thereof. These materials generally have a viscosity of from about 50 to about 4000 SUS at 100° F. and from about 30 to about 800 SUS at 210° F., preferably from about 50 to about 2000 SUS at 100° F., and a Viscosity Index of from about 0 to about 100 or higher.

When the base oil is a mineral oil, it can include a stock derived from refined or partly refined paraffinic, naphthenic, asphaltic and mixed base crude oil stocks having the properties listed above. Naphthenic or paraffinic oils having SUS viscosities of from about 75 to about 150 SUS are preferred, and more preferably 75 to about 95 SUS at 210° F. although the selection of the base stock viscosity will also depend on the end-use of the grease.

When the base oil is a synthetic oil it can include hydrocarbon, hydrocarbon polymer, esters of carboxylic acids, esters of phosphoric acid, halocarbon oils, alkyl silicates, sulfite esters, carbonates, mercaptals, formals, polyglycols and the like or mixtures thereof. For example, the synthetic oils can include oils such as di-2-ethylhexyl sebacate, di-$C_8$ Oxo azelate, and other simple esters of dicarboxylic acids, or more complex esters prepared from glycols, dicarboxylic acids, alcohols and mono carboxylic acids known in the art.

It is within the scope of the invention to add any conventional additives to the present lubricating grease compositions. These additives can be diverse structures and origins and include oxidation inhibitors such as phenyl-alpha-naphthamine, diphenyl amines, etc., extreme pressure agents, such as metallic naphthenates, sulfurized sperm oil, etc., corrosion inhibitors, metal deactivators, stabilizers, fillers and the like.

ILLUSTRATIVE EMBODIMENTS

The following embodiments are presented to illustrate the process of the invention and should not be regarded as limiting it in any way.

Embodiment 1

| Formulation | Weight % |
|---|---|
| fatty acid | 10.4 |
| lithium hydroxide | 1.1 |
| calcium hydroxide | 0.5 |
| oil | 70.4 |
| oil | 17.6 |

A lithium-calcium mixed soap grease was prepared by melting a minor amount of a mixture of lithium hydroxide, 12-hydroxystearic acid in 5000 g of high viscosity lubricating oil at 160° F., raising the temperature of the mixture to boil off water and continuing heating to 260° F. over about 25 minutes. Adding 4000 g additional oil while raising the temperature of the mixture to 370° F., adding 870 g additional oil while raising the temperature to about 400° F. The mixture is then sheared at about 100 to about 150 psi and cooling commenced so that the mixture thickens. The resulting mixture is cooled to about 336° F. and dry calcium hydroxide added portionwise over about 10 minutes. The resulting mixture is then stirred for about 20 minutes at about 330° F. to about 336° F. and then recirculated again while applying shear pressure of about 100 to 150 psi for about 45 minutes. Then the remaining oil is added slowly in order to both dilute and cool the resulting grease.

The resulting mixed lithium-calcium 12-hydroxystearate grease had the following properties by ASTM tests:

| Penetration (1/10's mm) at 77° F. | |
|---|---|
| worked 60 strokes (ASTM D-217) | 270 |
| after prolonged working of 100,000 | 290 |
| Roll stability, 96 hrs at 180° F., change in consistency, (1/10's mm) at 77° F. | +8 |

Embodiment 2 (Comparative Example)

A lithium-calcium mixed soap grease was prepared by melting a minor amount of a mixture of lithium hydroxide and 12-hydroxystearic acid in 5000 g of high viscosity lubricating oil at 150° F. , raising the temperature of the mixture to boil off water and continuing heating to about 260° F. over about 20 minutes. Adding 4000 g additional oil heated to about 240° F. and then raising the temperature of the mixture to about 400° F. Then the resulting mixture was sheared at about 100–150 psi while holding the temperature at 390° F. The grease mixture was then cooled to 200° F. Part of the water was added at about 200° F. followed by dry calcium hydroxide and then the remainder of the water. Alternatively the calcium hydroxide can be added as a water slurry at this point. The resulting mixture was heated to 210°–240° F. to boil off the water then further heated to about 350°. The mixture was then sheared at about 100 to 150 psi for 45 minutes to complete the dispersion of the thickener. The remainder of the oil was then added slowly to dilute the grease to the desired consistency and cool it.

The resulting mixed lithium-calcium 12-hydroxystearate grease had the following properties by ASTM tests:

| Penetration (1/10's mm) at 77° F. | |
|---|---|
| worked 60 strokes (ASTM D-217) | 302 |
| after prolonged working of 100,000 | 327 |
| Roll stability, 96 hrs at 180° F., change in consistency, (1/10's mm) at 77° F. | 20 |

Embodiment 3

To the 7-gallon open kettle was charged 3000 g of HVI-600 base stock and 900 g of hydrogenated castor oil fatty acids (a portion of the base stock was withheld at this stage to be used for cooling the batch later). A water slurry of 92 g of lithium hydroxide monhydrate was added to partially neutralize the fatty acids to form the lithium soap component of the final thickener. Then heating was commenced. At approximately 210° F. the water started to boil off. The flame height (heat input) was reduced until the water was completely boiled off, which occurred between 240°-260° F. At this time 2000 g of HVI-600 were added hot to the reactor to build the volume of grease in the kettle. Unlike the earlier work, this base stock charge was not needed to cool the batch. When the boiling stopped the flame height was increased until the desired top cooking temperature of 395°-400° F. was reached. The bottom opening of the kettle was unplugged and the grease was drawn from the kettle and recirculated by use of the pump. The valve in the pump discharge line was closed so that there was about 100-150 pounds pressure that was relieved through it. This is comparable to the milling.

In the relatively small laboratory kettle recirculation through the cool external pipes provides sufficient cooling to lower the batch temperature to 300°-330° F. Depending on the experiment we could then apply a low level of heat to maintain the desired temperature which is between 300°-345° F. A this point the dry calcium hydroxide was added and stirred into the mixture for 20-30 minutes. Longer times may be needed in larger production kettle. The external pump is then restarted and the grease is circulated through the partially closed valve to mill the mixed soap into the base stock and form the desired grease.

Traditional grease chemists and technologists have long been taught that water was essential to creating a "coupling" of the alkali and the fatty acid in the oil in order to get proper soap formation. In fact we have experienced problems with repeatability of batches of other greases when dry calcium hydroxide was added to the fatty acid-base stock mixture. Thus it was quite unexpected that calcium hydroxide could be added dry to an already formed lithium soap grease and form a mixed soap grease with the same or better mechanical stability characteristics than such mixed soap greases formed in sealed autoclaves. Earlier patents taught that such greases could not be made by simply mechanically mixing a lithium soap grease with a calcium soap grease.

Other concentrations of soap and combinations of base stocks are used for other applications, such as industrial grease lubrication, heavy duty equipment and automotive grease lubrication. Such greases are formed using the above same general method.

The grease formed by this invention is Embodiment 3 in Table I.

The advantages of this method include the ability to form mixed lithium-calcium greases without the use of expensive sealed autoclave vessels. Other advantages are better control over the dehydration of the calcium soap portion than is sometimes even achieved in sealed autoclaves. These improvements combine to prevent excessive dehydration of the calcium soap portion thus improving product quality and batch to batch repeatability. Another advantage is the avoidance of multiple heating and cooling steps in the production process. This saves both time and heating energy costs.

Embodiment 4

To the kettle was charged 3000 g of HVI-600 base stock and 900 g of hydrogenated castor oil fatty acids (a portion of the base stock was withheld at this stage to be used for cooling the batch later). A water slurry of 92 g of lithium hydroxide monohydrate was added to partially neutralize the fatty acids to form the lithium soap component of the final thickener. Then heating was commenced. At approximately 210° F. the water started to boil off. The flame height (heat input) was reduced until the water was completely boiled off, which occurred between 240°-260° F. When the boiling stopped the flame height was increased until the desired top cooking temperature of 395°-400° F. was reached. The bottom opening of the kettle was unplugged and the grease was drawn from the kettle and recirculated by use of the pump. The valve in the pump discharge line was closed so that there was about 100-150 pounds pressure that was relieved through it. This is comparable to the milling noted above. The 2000 g of HVI 600 base stock withheld earlier was added slowly at this time to aid cooling. This milling and circulation through the relatively cool external piping also cooled the lithium soap grease to about 300° F. The mixture was then allowed to cool to 210° F. or below for the next step.

At 210° F. or below a water slurry of 41 g of calcium hydroxide was then added to the kettle and the temperature of about 200°-210° F. was maintained for approximately 20 minutes to allow reaction of the calcium hydroxide with the remaining excess of hydrogenated castor oil fatty acids. (Alternately the calcium hydroxide can be added dry, preceded or followed by the same amount of water used to make the slurry.) Heat was again applied slowly to raise the temperature and boil off the water that had been added to kettle. When all the water was boiled off the mixture was heated to 315°-335° F. When the desired temperature was reached the pump was restarted and the grease again milled to complete the formation of the mixed lithium-calcium soap grease. During this cooling and milling period the remaining 2005 g of HVI 600 base stock and 1751 g of HVI 150 bright stock were added. The HVI 150 BS is required to produce the proper mineral oil base stock viscosity for the particular railroad application of the example greases cited here. The greases formed are Embodiments 4-6 in Table I.

TABLE I

| Embodiment | % HCOFA | % LiOH | Ca (OH) | Top Temp | Mill Temp | Temp For 2nd addn | Temp For Mill 2d | Unw Pen | Wkd Pen | 100k Strokes | 100k Change | Roll Test Change Before | Roll Test Change After | |
|---|---|---|---|---|---|---|---|---|---|---|---|---|---|---|
| 4 | 10.40 | 1.10 | 0.50 | 395 | 395 | 200 | 300 | 350 | 353 | 364 | 11 | 175 | 172 | −6 |
| 5 | 10.40 | 1.10 | 0.50 | 395 | 395 | 201 | 320 | 311 | 307 | 321 | 14 | 152 | 162 | 20 |
| 6 | 10.40 | 1.10 | 0.50 | 395 | 395 | 200 | 330 | 281 | 295 | 321 | 26 | 145 | 154 | 18 |
| 3 | 10.40 | 1.10 | 0.50 | 400 | 400 | 336 (dry) | 332 | 266 | 270 | 290 | 20 | 134 | 137 | −6 |

HCOFA means fatty acid.
Top Temp means maximum temperature in step (b).
Mill Temp means maximum temperature in step (c).
2nd addn. means maximum temperature in step (e).
Mill 2d means maximum temperature in step (f).
Unw pen means unworked full scale penetration at 77° F.
Wkd pen means worked full scale penetration at 77° F.
100K strokes means 100,000 stroke work penetration.
100K change means change from 60 stroke to 100,000 stroke work penetration.
Before means before roll test.
After means penetration after roll test.
Roll test change means change in penetration in full scale penetration points in roll stability test.

What is claimed is:

1. A process for the preparation of a lubricating grease which comprises (a) dispersing in a major amount of a lubricating oil at about 180° F. to about 200° F. an effective amount of a saponifiable fatty material and lithium base to partially neutralize the fatty material, (b) then heating the resulting mixture from (a) to about 385° F. to about 410° F. at about ambient pressure to dissolve said fatty material, (c) homogenizing the resulting mixture from (b) at about 80 to about 200 psi while maintaining the temperature, (d) cooling the resulting mixture from (c) to a temperature below about 370° F., (e) adding calcium base to the resulting mixture from (d) to saponify the remaining unsaponified fatty material while maintaining the mixture at or reheating the mixture about 290° F. to about 360° F. and about ambient pressure, and (f) homogenizing the resulting mixture at about 100 to about 150 psi while maintaining the temperature to obtain a lithium-calcium mixed soap lubricating grease composition.

2. A process according to claim 1 wherein the saponifiable material is a fatty acid.

3. A process according to claim 2 wherein the fatty acid is 12-hydroxystearic acid and the lithium and calcium bases are lithium and calcium hydroxide.

4. A process according to any one of claims 1, 2, or 3 wherein the calcium base is calcium hydroxide and is added in step (e) in substantially dry form at a temperature of from about 310° to about 360° F.

5. A process according to claim 4 wherein the cooling in step (d) is to about 280° F. to about 360° F.

6. A process according to any one of claims 1, 2 or 3 wherein the cooling in step (d) is to below about 200° F. and the calcium base is added in step (e) as an aqueous slurry.

* * * * *